US008182243B2

(12) United States Patent
Ward

(10) Patent No.: US 8,182,243 B2
(45) Date of Patent: May 22, 2012

(54) CONDENSATE PUMP

(75) Inventor: Charles Barry Ward, Alpharetta, GA (US)

(73) Assignee: Diversitech Corporation, Duluth, GA (US)

( * ) Notice: Subject to any disclaimer, the term of this patent is extended or adjusted under 35 U.S.C. 154(b) by 950 days.

(21) Appl. No.: 12/192,529

(22) Filed: Aug. 15, 2008

(65) Prior Publication Data

US 2010/0037644 A1 Feb. 18, 2010

(51) Int. Cl.
*F04B 17/04* (2006.01)
*H02K 7/00* (2006.01)
*H02K 35/02* (2006.01)

(52) U.S. Cl. ..... 417/363; 417/417; 310/19; 310/34

(58) Field of Classification Search ..... 417/416, 417/417, 363; 310/15, 19, 24, 30, 34
See application file for complete search history.

(56) References Cited

U.S. PATENT DOCUMENTS

| | | | | |
|---|---|---|---|---|
| 2,776,554 | A | | 1/1957 | Pigman |
| 2,822,442 | A | | 2/1958 | Jones |
| 2,918,016 | A | | 12/1959 | Olson |
| 2,971,467 | A | | 2/1961 | Konopka et al. |
| 2,981,196 | A | | 4/1961 | Zimmermann et al. |
| 3,587,234 | A | | 6/1971 | McQueen |
| 3,696,629 | A | | 10/1972 | Heston |
| 3,758,236 | A | | 9/1973 | Zimmerman |
| 4,079,436 | A | | 3/1978 | Brown |
| 4,413,950 | A | | 11/1983 | Wiernicki |
| 4,706,470 | A | * | 11/1987 | Akazawa et al. ..... 62/209 |
| 4,778,353 | A | * | 10/1988 | Wiernicki ..... 417/53 |
| 4,897,023 | A | | 1/1990 | Bingler |
| 4,964,609 | A | * | 10/1990 | Tomell ..... 248/638 |
| 4,964,786 | A | * | 10/1990 | Maertens ..... 417/363 |
| 4,982,576 | A | | 1/1991 | Proctor et al. |
| 5,012,768 | A | | 5/1991 | Roschinski |
| 5,073,095 | A | | 12/1991 | Thomas |
| 5,106,267 | A | * | 4/1992 | Kawamura et al. ..... 417/45 |
| 5,188,710 | A | | 2/1993 | Weber et al. |
| 5,201,339 | A | | 4/1993 | Buchan et al. |
| 5,461,879 | A | | 10/1995 | Bolton et al. |
| 5,562,003 | A | | 10/1996 | Lefebvre |
| 5,651,259 | A | | 7/1997 | Twyman |

(Continued)

FOREIGN PATENT DOCUMENTS

JP 361200843 9/1986

(Continued)

OTHER PUBLICATIONS

The International Search Report issued by the USPTO for PCT/US09/53659 on Oct. 9, 2009.

*Primary Examiner* — Charles Freay
(74) *Attorney, Agent, or Firm* — Smith Gambrell & Russell LLP

(57) ABSTRACT

A condensate pump for an HVAC system includes a reservoir, a solenoid pump assembly with a solenoid pump, and a solenoid pump electronic control module for limiting the amount of energy delivered to the solenoid pump during one half cycle from an AC current source. The solenoid pump is mounted in the solenoid pump assembly by means of shock absorbing material, and the solenoid pump assembly is mounted on a support member with shock absorbing material interposed between the solenoid pump assembly and the support member.

9 Claims, 7 Drawing Sheets

U.S. PATENT DOCUMENTS

| | | | | |
|---|---|---|---|---|
| 6,106,225 | A | 8/2000 | Enns | |
| 6,203,288 | B1 | 3/2001 | Kottke | |
| 6,283,717 | B1 | 9/2001 | Yamada | |
| 6,322,326 | B1 | 11/2001 | Davis et al. | |
| 6,341,944 | B1 | 1/2002 | Butcher | |
| 6,372,126 | B1 | 4/2002 | Reeves | |
| 6,565,325 | B2 | 5/2003 | Belehradek | |
| 2002/0176782 | A1 | 11/2002 | Batchelder et al. | |
| 2004/0096345 | A1 | 5/2004 | Zabar | |
| 2006/0034708 | A1 | 2/2006 | Thomas | |
| 2006/0034709 | A1 | 2/2006 | Thomas | |
| 2006/0034710 | A1 * | 2/2006 | Moretti | 417/417 |
| 2007/0028640 | A1 | 2/2007 | Hampton | |
| 2008/0267798 | A1 * | 10/2008 | Liu et al. | 417/416 |

FOREIGN PATENT DOCUMENTS

| | | |
|---|---|---|
| JP | 2001230115 | 8/2001 |

* cited by examiner

CONDENSATE PUMP

FIELD OF THE INVENTION

This invention relates to a condensate pump that collects condensate water from the evaporator of an HVAC system and pumps the condensate water to another location for disposal. More specifically, the condensate pump of the present invention includes a mounting system for a solenoid pump and a drive circuit for the solenoid pump to reduce noise and to increase operating efficiency.

BACKGROUND OF THE INVENTION

A condensate pump collects condensate water from the evaporator of the HVAC system and pumps the condensate water to a remote location for disposal. Particularly, a conventional condensate pump comprises a reservoir for collecting condensate water from the evaporator of the HVAC system, an impeller pump for pumping the water out of the reservoir to the remote location, and an electric motor to drive the impeller pump. A float in the reservoir detects the level of condensate water in the reservoir and activates control circuitry to control the operation of the electric motor.

In some smaller HVAC systems, the condensate pump may employ a solenoid pump, instead of an impeller pump, and a condensate water collection reservoir. In some instances, the solenoid pump and the reservoir may be separate. A conventional solenoid pump is designed to operate at a fixed AC input voltage and frequency, for example, standard household current of 120 volts at 60 Hz. Such a conventional solenoid pump 2 is shown in FIG. 1. The conventional solenoid pump 2 comprises a pump cylinder 4 with an inlet 6 and an outlet 8. A hollow cylindrical plunger 10 is slidably mounted within a pressure chamber 14 of the pump cylinder 4. The plunger 10 is driven toward the inlet 6 by means of an electromagnetic solenoid coil 22. The plunger 10 is driven toward the outlet 8 by means of a plunger spring 20. The plunger 10 has an internal plunger channel 12 which forms a communication channel between the inlet 6 and the pressure chamber 14 of the pump cylinder 4. A first check valve 16 engages the plunger channel 12 within the pressure chamber 14. A second check valve 18 seals the pressure chamber 14 adjacent outlet 8.

In operation, the electromagnetic solenoid coil 22 is connected through a diode to a source of AC current with a frequency of 50/60 Hz. The voltage from the source of AC current is shown as a full waveform 24 in FIG. 2. The voltage applied to the electromagnetic solenoid coil 22, as a result of the operation of the diode, is shown as a half wave rectified waveform 26 in FIG. 2. The half wave rectified waveform 26 has intake portions 28 and discharge portions 30. During intake portions 28 of the rectified waveform 26, the electromagnetic solenoid coil 22 is energized, and the plunger 10 is driven by the electromagnetic solenoid coil 22 toward the inlet 6. As the plunger 10 is driven toward the inlet 6 by the electromagnetic solenoid coil 22 (intake portion 28), the first check valve 16 allows entry of condensate water into the pressure chamber 14 of the pump cylinder 4, while the second check valve 18 precludes condensate water from flowing back into the pressure chamber 14 from the outlet 8. During discharge portions 30 of the rectified waveform 26, the electromagnetic solenoid coil 22 is de-energized, and the plunger 10 is driven by the plunger spring 20 toward the outlet 8. As the plunger 10 is driven toward the outlet 8 by the plunger spring 20 (discharge portion 30), the first check valve 16 seals the plunger channel 12 so that the condensate water in the pressure chamber 14 is forced through the second check valve 18 and out of the outlet 8.

Due to the electromagnetic effects of the electromagnetic solenoid coil 22, the mechanical harmonics with the plunger spring 20, and the dynamics of varying suction and discharge pressures, it is impossible for the prior art solenoid pump 2 connected to an AC current source through a single diode to operate efficiently under all conditions. Particularly, during the time in which the AC current in the electromagnetic solenoid coil 22 is driving the plunger 10 toward the inlet 6 (intake portion 28), current continues to flow into the electromagnetic solenoid coil 22 even after the plunger 10 has reached the end of its travel. The continuing application of current to the electromagnetic solenoid coil 22 after the plunger 10 has reached the end of its travel causes an unnecessary buildup of heat in the electromagnetic solenoid coil 22. Such a buildup of heat limits the range of voltages and frequencies over which the solenoid pump 2 will operate. In addition, using the half wave rectified waveform 26 causes the plunger 10 to slam into the end of the pump cylinder 4 at the end of the plunger's travel as the plunger 10 compresses the plunger spring 20. Consequently, the conventional solenoid pump 2 connected to a source of AC current through a single diode is noisy.

SUMMARY OF THE INVENTION

An object of the present invention is to provide a solenoid pump with increased energy efficiency, lower audible sound levels, and enhanced compatibility with varying AC current sources.

In order to increase efficiency, the present invention includes a solenoid pump electronic control module that controls the current flowing to the electromagnetic solenoid coil during the intake portion of the pump cycle. Particularly, the electronic control module cuts off current to the electromagnetic solenoid coil when the plunger has been driven to its end point against the force of the plunger spring. By cutting off current to the electromagnetic solenoid coil once the plunger has reached its end point during the intake portion of the pump cycle, additional current does not flow to the electromagnetic solenoid coil thereby reducing unnecessary heating of the coil. Because of the efficiency gained from cutting off current to the electromagnetic solenoid coil once the plunger has been driven to its endpoint, the solenoid pump of the present invention can operate using AC current sources having voltages ranging between 100 and 250 volts at 50/60 Hz.

In order lower the levels of audible sound created by a conventional solenoid pump, the solenoid pump of the present invention also employs a mounting system for the solenoid pump within a solenoid pump assembly as well as a mounting arrangement for attaching the solenoid pump assembly of the present invention to a support member. In addition, the operation of the electronic control module as described above keeps the plunger from slamming into the end of the cylinder housing during the intake portion of the pump cycle.

Further objects, features and advantages will become apparent upon consideration of the following detailed description of the invention when taken in conjunction with the drawings and the appended claims.

DETAILED DESCRIPTION OF AN EMBODIMENT

Figure 3:
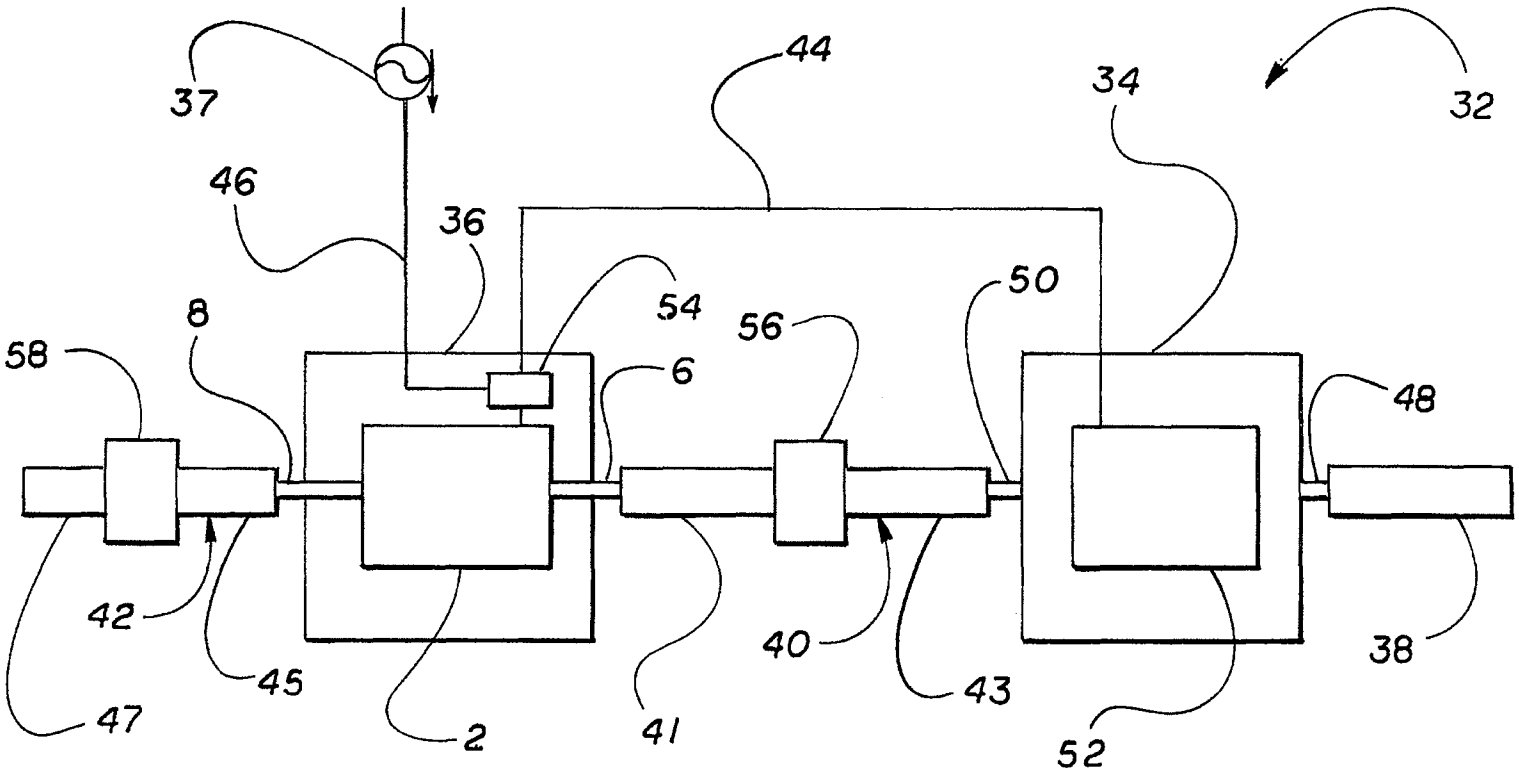
FIG. 3 is a schematic diagram of a condensate pump in accordance with the present invention.

Turning to FIG. 3, a condensate pump 32 in accordance with the present invention comprises a reservoir 34 and a solenoid pump assembly 36. For the condensate pump 32, the reservoir 34 and the solenoid pump assembly 36 may be separated with the reservoir 34 located near the evaporator of the HVAC system. Alternatively, the solenoid pump assembly 36 and the reservoir 34 could be assembled as a single unit. The reservoir 34 has a reservoir inlet 48 and a reservoir outlet 50. The solenoid pump assembly 36 includes the solenoid pump 2 that has a solenoid pump inlet 6 and a solenoid pump outlet 8. Condensate water from the evaporator of the HVAC system is delivered by gravity to the reservoir inlet 48 of the reservoir 34 by means of an evaporator hose 38 connected between the evaporator and the reservoir inlet 48 of the reservoir 34. The solenoid pump inlet 6 of the solenoid pump assembly 36 is connected to the reservoir outlet 50 of the reservoir 34 by a suction hose 40. The suction hose 40 comprises a first suction hose section 41 and a second suction hose section 43 connected together by means of a suction hose bellows 56. The suction hose bellows 56 is flexible and provides noise and vibration isolation between the condensate pump assembly 36 and the reservoir 34.

As the solenoid pump 2 within the solenoid pump assembly 36 cycles, condensate water is drawn from the reservoir 34 through the suction hose 40 to the solenoid pump 2 and discharged through solenoid pump outlet 8 and discharge hose 42 connected to the solenoid pump outlet 8. The discharge hose 42 comprises a first discharge hose section 45 and a second discharge hose section 47 connected together by means of a discharge hose bellows 58. The discharge hose bellows 58 is flexible and provides noise and vibration isolation between the condensate pump assembly 36 and anything in contact with the second discharge hose section 47 of the discharge hose 42.

With continuing reference to FIG. 3, the Condensate pump assembly 36 further includes a power cable 46 connected to an AC current source 37 for delivering AC current to the solenoid pump 2. A control cable 44 connects a signal generated by a float control module 52 in the reservoir 34 to a solenoid pump electronic control module 54 in the solenoid pump assembly 36. The float control module 52 determines the level of condensate water in the reservoir 34 and signals the electronic control module 54 to start and stop the solenoid pump 2.

Figure 4:
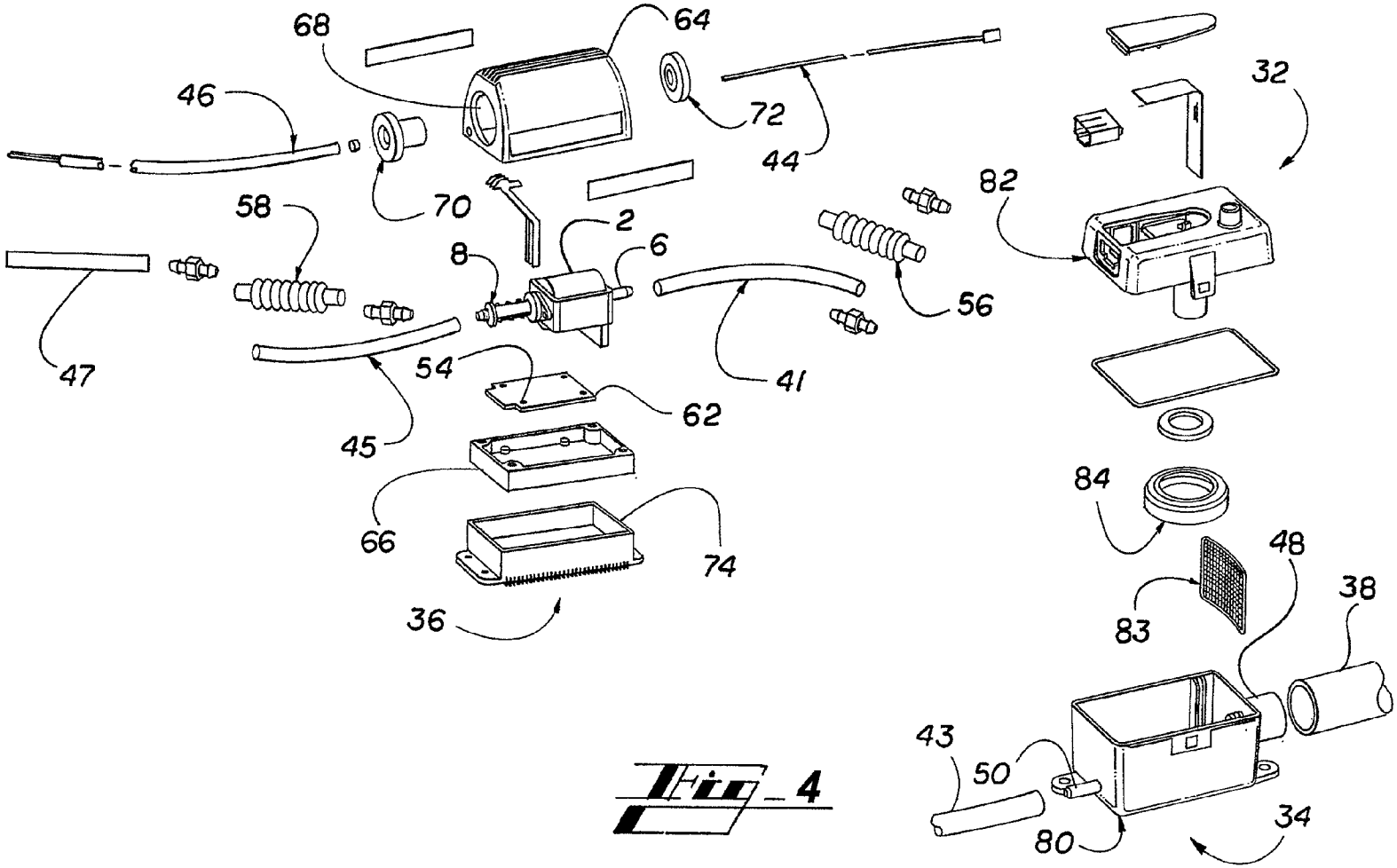
FIG. 4 is an exploded view of the condensate pump shown schematically in FIG. 3 in accordance with the present invention.
Figure 5:
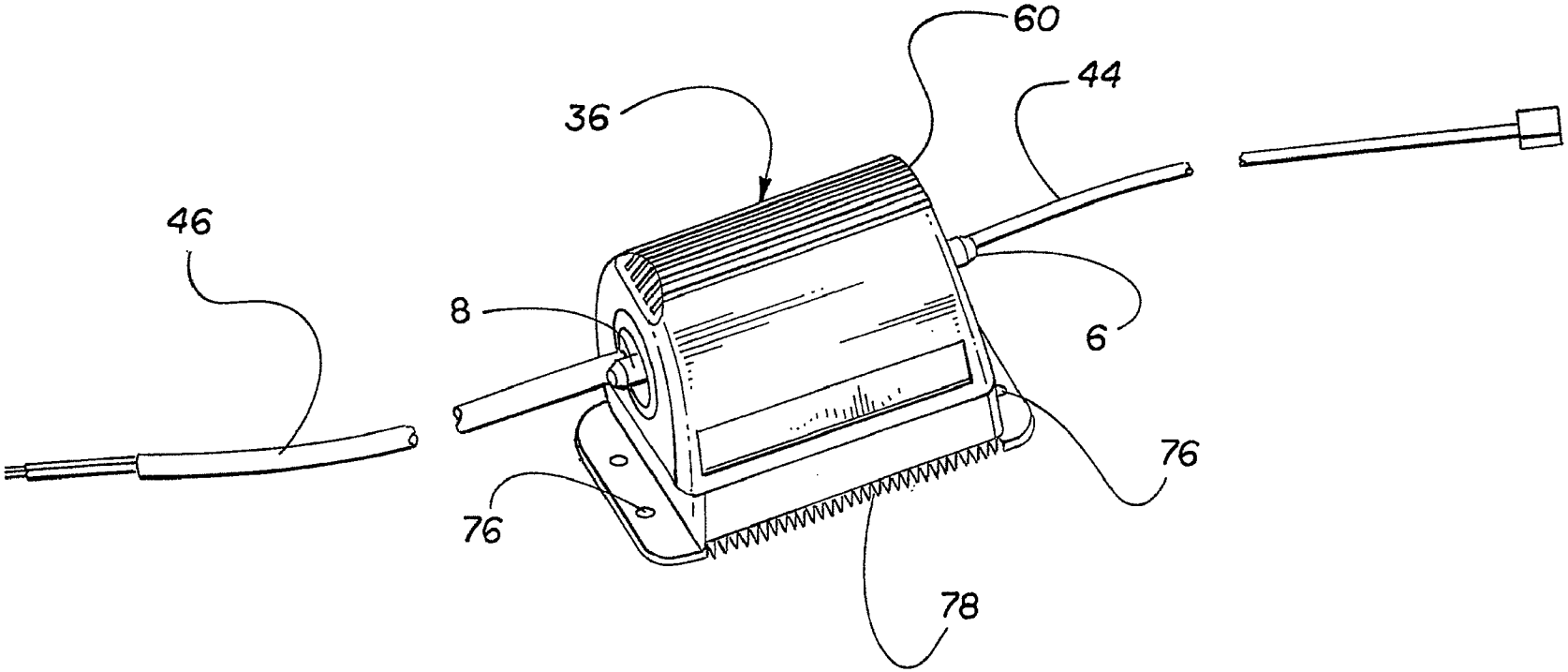
FIG. 5 is a perspective view of the solenoid pump assembly of the condensate pump in accordance with the present invention.
Figure 6:
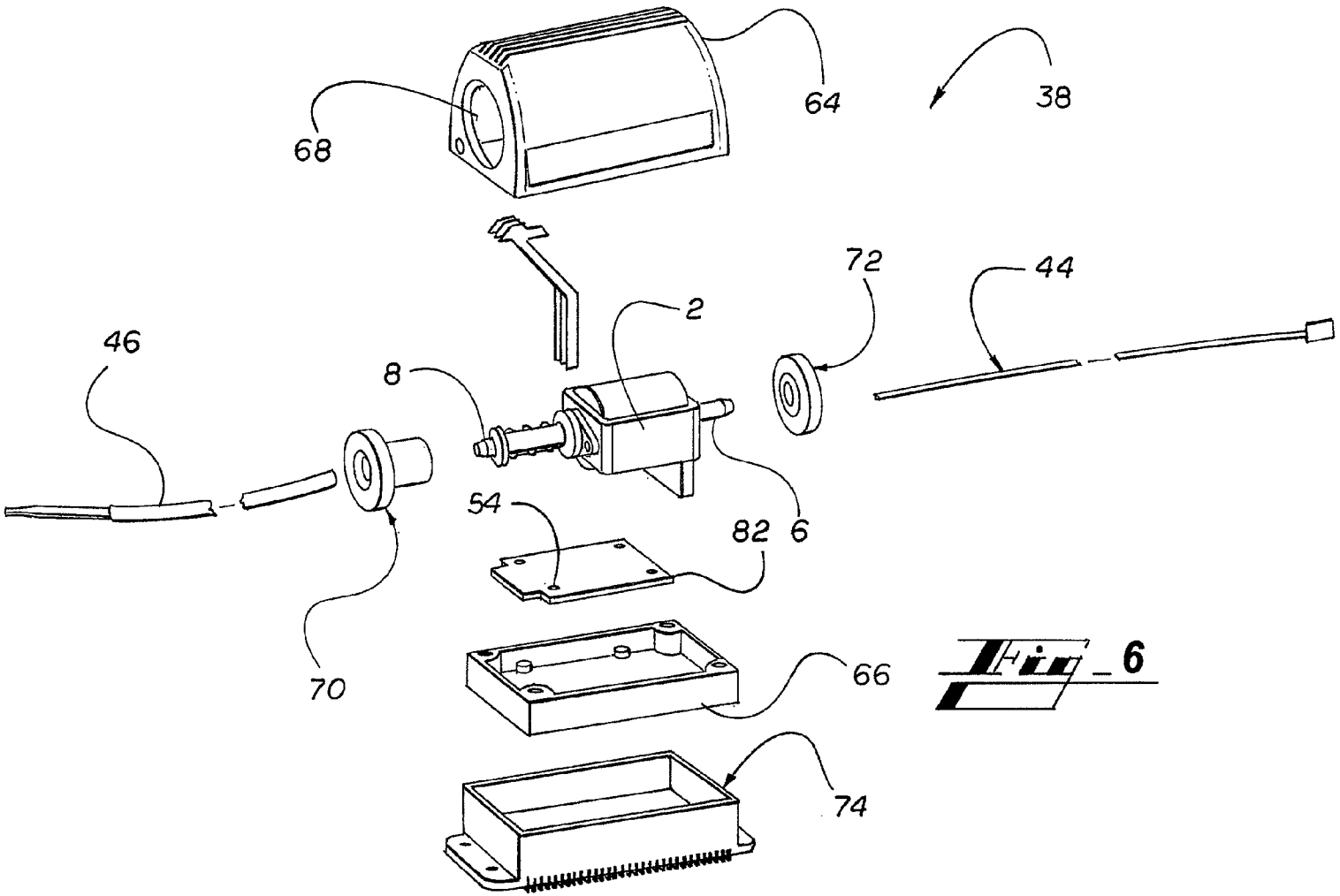
FIG. 6 is an exploded view of the solenoid pump assembly of the condensate pump in accordance with the present invention.
Figure 8:
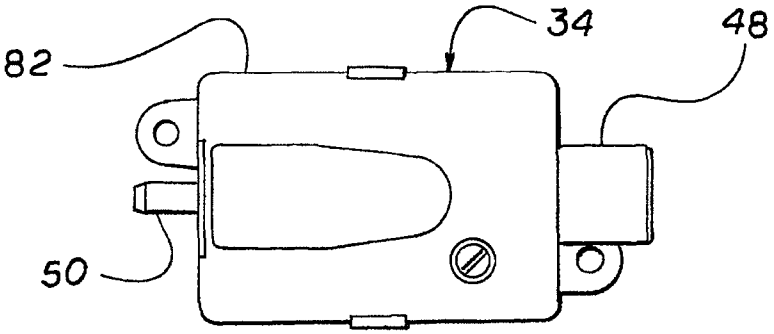
FIG. 8 is top plan view of the reservoir of the condensate pump in accordance with the present invention.
Figure 7:
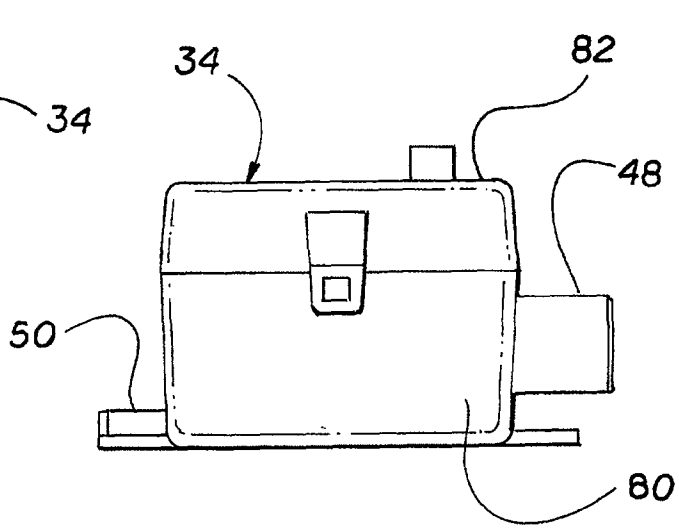
FIG. 7 is a front elevation view of the reservoir of the condensate pump in accordance with the present invention.
Figure 10:
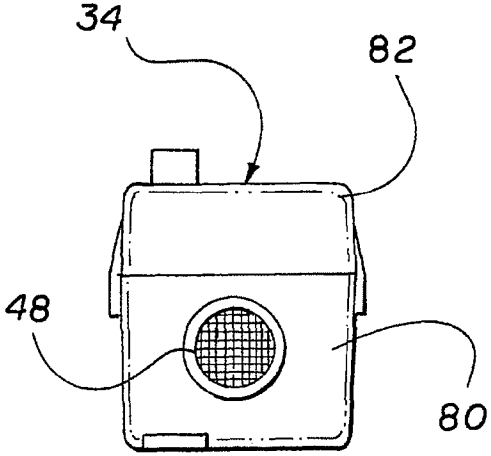
FIG. 10 is a side elevation view of the reservoir of the condensate pump in accordance with the present invention.
Figure 9:
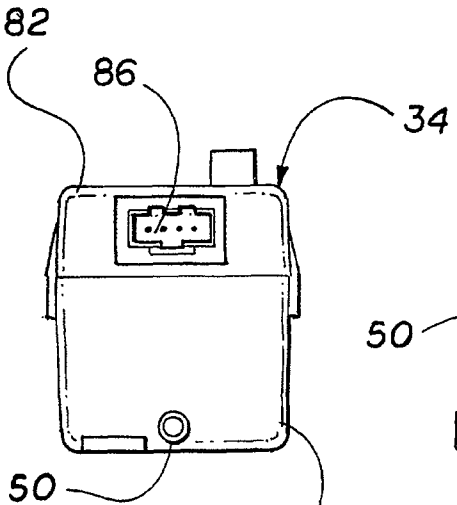
FIG. 9 is side elevation view of the reservoir of the condensate pump in accordance with the present invention.
Figure 11:
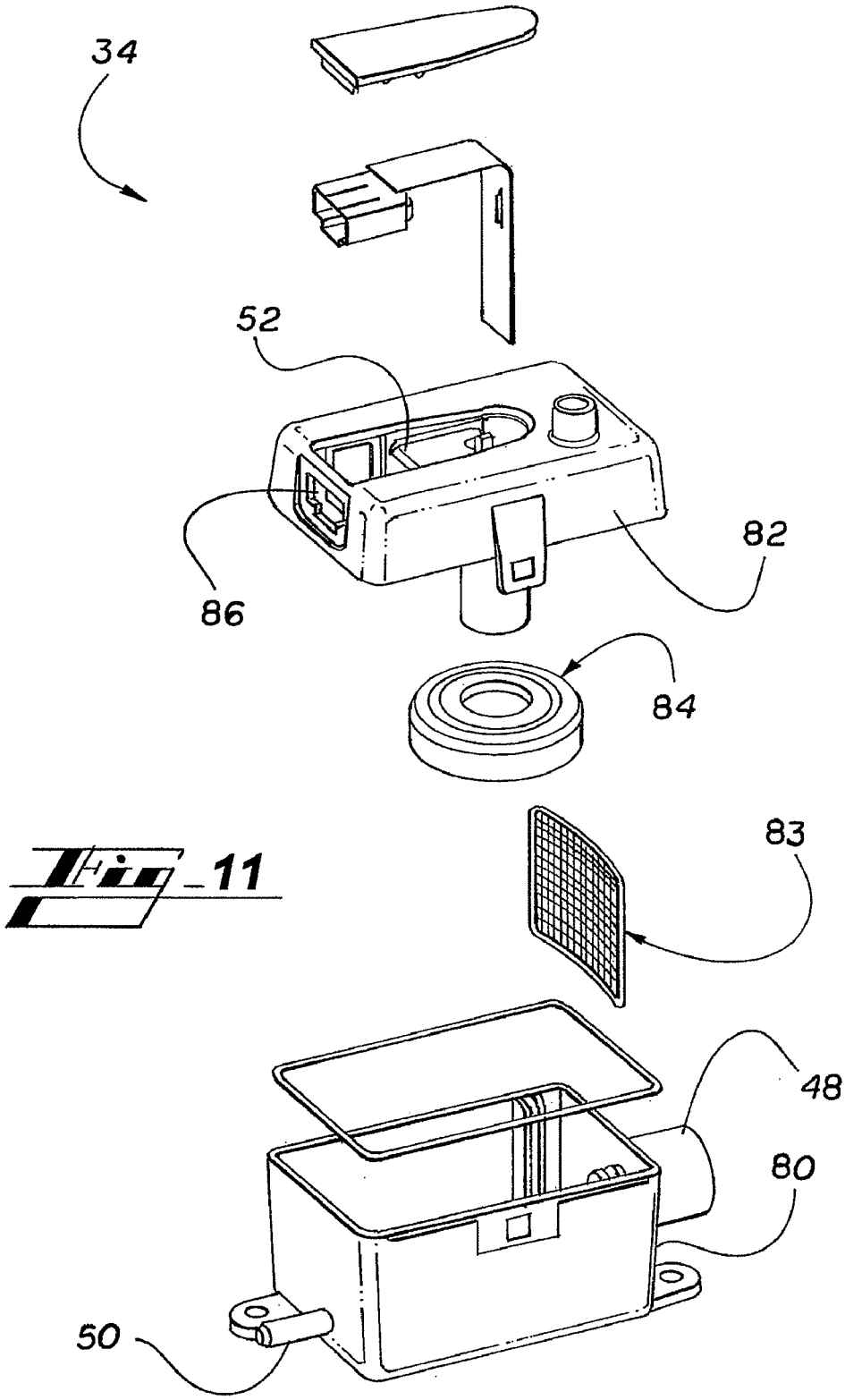
FIG. 11 is an exploded view of the reservoir of the condensate pump in accordance with the present invention.

FIG. 4 is an exploded view of the condensate pump 32 showing the components of the reservoir 34 and the solenoid pump assembly 36. The solenoid pump assembly 36 is shown in greater detail in FIGS. 5 and 6. The solenoid pump assembly 36 comprises a housing 60 (FIG. 5) for enclosing the condensate pump 2 and a circuit board 62. The electronic control module 54 is mounted on the circuit board 62. The housing 60 comprises a metal cover 64 and a metal base 66. The cover 64 has a mounting opening 68 on one end of the metal cover 64 and a matching mounting opening on the other end of the metal cover 64. A shock absorbing material comprising a first rubber mounting grommet 70 captures the outlet 8 of the solenoid pump 2 in the mounting opening 68, and a shock absorbing material comprising a second rubber mounting grommet 72 captures the inlet 6 of the solenoid pump 2 in the opposite mounting opening of the metal cover 64. The rubber mounting grommets serve to isolate the noise and vibration created by the solenoid pump 2 from the metal cover 64 of the housing 60. A shock absorbing material comprising a rubber mounting case 74 surrounds and is attached to the base 66 of the housing 60. The rubber mounting case 74 has flexible ribs 78 on its underside and mounting holes 76 for attaching the solenoid pump assembly 36 to a support member. The rubber mounting case 74 with its flexible ribs 78 are positioned between the support member and the metal base 66 and serve to isolate vibrations of the solenoid pump assembly 36 from the support member on which the solenoid pump assembly 36 may be mounted.

Turning to FIGS. 7-11, the reservoir 34 comprises a tank 80, a tank cover 82, and the float control module 52 with its associated float 84. The tank 80 has the reservoir inlet 48, with a screen 83, for receiving condensate water from the evaporator of the HVAC system and the outlet 50 for connection to the suction hose 40. The tank cover 82 supports the float control module 52. The float 84 moves up and down with the condensate water level in the tank 80, and the float control module 52 produces a float control signal at an output connector 86 that is related to the level of the condensate water in the tank 80. The connector 86 is connected to the control cable 44 (FIGS. 3 and 4). The control cable 44 is connected to the solenoid pump electronic control module 54 on the circuit board 62 of the solenoid pump assembly 36 so that the flow control signal starts and stops the solenoid pump 2.

Figure 1:
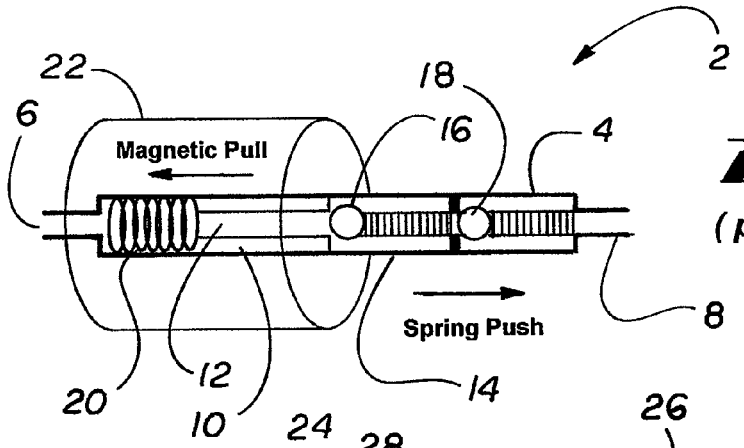
Fig. 1 ( prior art )
FIG. 1 is a schematic diagram of a solenoid pump in accordance with the prior art.
Figure 2:
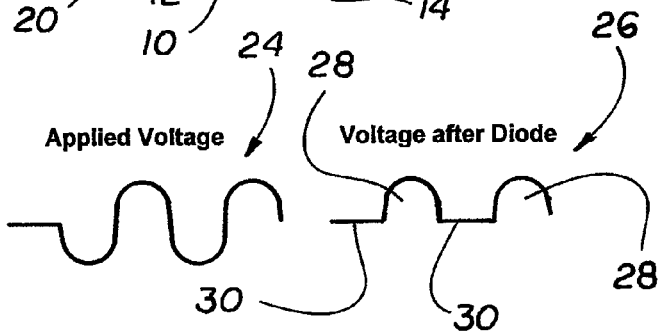
Fig. 2 ( prior art )
FIG. 2 is a schematic diagram of waveforms associated with an AC current source used to drive the solenoid pump of FIG. 1.
Figure 12:
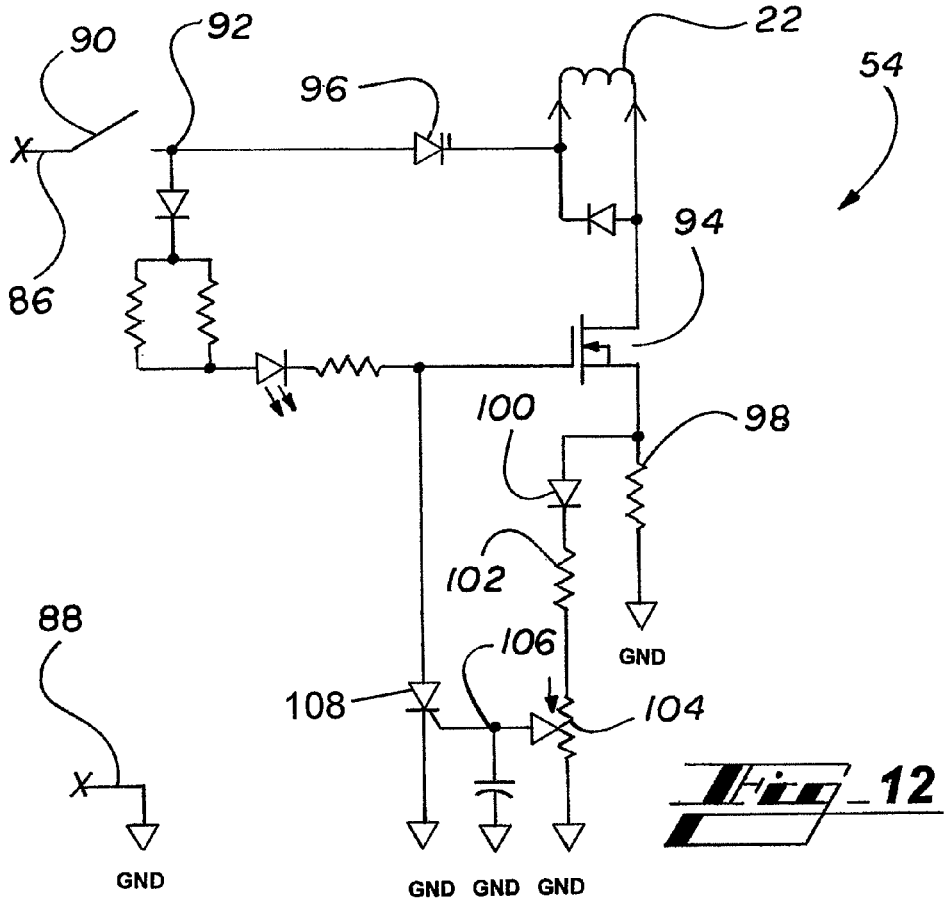
FIG. 12 is a schematic diagram of the solenoid pump electronic control module of the condensate pump in accordance with the present invention.

In order to reduce noise and increase the efficiency of the solenoid pump 2, the AC current source 37 (FIG. 3) is connected to the electromagnetic solenoid coil 22 by means of power cable 46 and by means of pump control module 54 shown schematically in FIG. 12. Particularly, AC input terminals 86 and 88 of pump control module 54 are connected to the AC current source 37. A normally open relay switch 90 connects the AC current source 37 to the pump control module 54. The relay switch 90 is controlled by the float control signal from the float control module 52 in the reservoir 34. When the flow control module 52 in the reservoir 34 determines that the float 84 has reached a level in the reservoir at which pumping should begin, the float control signal generated by the float control module 52 is connected to the electronic control module 54 by means of control cable 44. The flow control signal closes the switch 90 thereby connecting the AC current source 37 to the pump control module 54. With the switch 90 closed, the rising AC voltage (waveform 24, FIG. 2) drives node 92 positive during the intake portion 28 (FIG. 2) of the pump cycle. The positive voltage at node 92 during the intake portion 28 of the pump cycle causes power FET 94 to conduct. The majority of the current conducted through FET 94 passes through diode 96, the electromagnetic solenoid coil 22, and current sensing resistor 98. Because the electromagnetic solenoid coil 22 is designed to allow operation from an AC current source of 50 Hz or 60 Hz, the inductance of the electromagnetic solenoid coil 22 is large, and the current in the electromagnetic solenoid coil 22 lags the voltage across the electromagnetic solenoid coil 22. As the current rises in the electromagnetic solenoid coil 22, the plunger 10 (FIG. 1) begins to move and compress the plunger spring 20. Simultaneously, as the current rises in the electromagnetic solenoid coil 22, the voltage developed across current sensing resistor 98 rises. Once the voltage across current sensing resistor 98 rises to a value determined by the voltage drops across diode 100, resistor 102, and voltage divider resistor 104, the voltage at node 106 rises to a value sufficient to fire thyristor 108. The conduction of thyristor 108 pulls the gate voltage of FET 94 to ground, shutting off current flow to the electromagnetic solenoid coil 22 for the remainder of the intake portion 28 of the pump cycle 26 (FIG. 2). Once the current is shut off to the electromagnetic solenoid coil 22 by the action of the FET 94, the plunger spring 20 drives the plunger 10 toward the outlet 8 thereby discharging the condensate water from the pump.

By adjusting the setting of the voltage divider resistor 104, the amount of energy delivered to the electromagnetic solenoid coil 22 during the intake portion 28 of each half cycle may be adjusted to give optimum performance and minimum audible noise. Due to the self-regulating operation of the solenoid pump control module 54, a standard solenoid pump 2 designed for a specific operating voltage and frequency, such as 100 volts at 60 Hz may be operated over an extended range which includes 100-250 volts at 50/60 Hz without undue strain on the electromagnetic solenoid coil 22 or the plunger 10.

While this invention has been described with reference to one embodiment thereof, it is to be understood that variations and modifications can be affected within the spirit and scope of the invention as described herein and as described in the appended claims.

I claim:

1. A condensate pump for collecting condensate water and pumping the condensate water to a remote location comprising:

a. a condensate water reservoir for collecting condensate water;

b. a solenoid pump comprising:

i. a cylinder with an inlet and an outlet;

ii. a plunger slidably mounted in the cylinder for drawing condensate water into the cylinder from the reservoir and discharging the condensate water out of the cylinder; and iii. an electromagnetic solenoid coil for moving the plunger within the cylinder;

c. an AC current source having a first half cycle and a second half cycle; and d. a solenoid pump control module connected to the AC current source, wherein the solenoid pump control module:

i. connects the AC current source to the electromagnetic solenoid coil of the solenoid pump during the first half cycle of the AC current source; and ii. disconnects the AC current source from the electromagnetic solenoid coil of the solenoid pump when a preselected amount of energy has been delivered to the electromagnetic solenoid coil.

2. The condensate pump of claim 1, wherein the preselected amount of energy is sensed by the amount of current flowing through the electromagnetic solenoid coil.

3. The condensate pump of claim 1, wherein the preselected amount of energy is adjustable.

4. A condensate pump for collecting condensate water and pumping the condensate water to a remote location comprising:

a. a condensate water reservoir for collecting condensate water;

b. a solenoid pump assembly comprising:

i. a housing for mounting on a support member;

ii. a shock absorbing case positioned between the housing and the support surface; and iii. a solenoid pump connected to the condensate water reservoir for drawing condensate water from the reservoir and pumping the condensate water to a the remote location, wherein the solenoid pump is mounted by means of shock absorbing material within the housing.

5. The condensate pump of claim 4, wherein the condensate water reservoir and the solenoid pump assembly are separate one from the other and are connected by a suction hose so that the condensate pump can draw condensate water from the reservoir.

6. The condensate pump up claim 5, wherein the suction hose includes a flexible bellows.

7. A solenoid pump comprising:

a. a cylinder with an inlet and an outlet;

b. a plunger slidably mounted in the cylinder for drawing condensate water into the cylinder from the reservoir and discharging the condensate water out of the cylinder;

c. an electromagnetic solenoid coil for moving the plunger within the cylinder;

d. an AC current source having a first half cycle and a second half cycle; and e. a solenoid pump control module connected to the AC current source, wherein the solenoid pump control module:

i. connects the AC current source to the electromagnetic solenoid coil of the solenoid pump during the first half cycle of the AC current source; and ii. disconnects the AC current source from the electromagnetic solenoid coil of the solenoid pump when a preselected amount of energy has been delivered to the electromagnetic solenoid coil.

8. The condensate pump of claim 7, wherein the preselected amount of energy is sensed by the amount of current flowing through the electromagnetic solenoid coil.

9. The condensate pump of claim 7, wherein the preselected amount of energy is adjustable.

* * * * *